US005235301A

United States Patent [19]

Dittmann et al.

[11] Patent Number: 5,235,301

[45] Date of Patent: Aug. 10, 1993

[54] ELECTROMAGNETIC RELAY

[75] Inventors: Michael Dittmann; Horst Hendel, both of Berlin, Fed. Rep. of Germany

[73] Assignee: Siemens Aktiengesellschaft, Munich, Fed. Rep. of Germany

[21] Appl. No.: 838,801

[22] PCT Filed: Dec. 3, 1990

[86] PCT No.: PCT/EP90/02077

§ 371 Date: Mar. 18, 1992

§ 102(e) Date: Mar. 18, 1992

[87] PCT Pub. No.: WO91/11818

PCT Pub. Date: Aug. 8, 1991

[30] Foreign Application Priority Data

Jan. 30, 1990 [EP] European Pat. Off. ..... 90101826.7

[51] Int. Cl.[5] ..... H01H 51/22

[52] U.S. Cl. ..... 335/78; 335/83; 335/128

[58] Field of Search ..... 335/78-86, 335/131, 132, 128, 124, 202

[56] References Cited

U.S. PATENT DOCUMENTS 4,837,538 9/1988 Dittmann .

FOREIGN PATENT DOCUMENTS 0082238 4/1982 European Pat. Off. .
0281950 3/1988 European Pat. Off. .
2854591 12/1978 Fed. Rep. of Germany .
3428595 8/1984 Fed. Rep. of Germany .
2473780 11/1980 France .
1600762 12/1977 United Kingdom .

*Primary Examiner*—Lincoln Donovan
*Attorney, Agent, or Firm*—Hill, Steadman & Simpson

[57] ABSTRACT

A relay has a coil body (1) as a support for a magnet system and also a base. Coil connection elements (3, 4) serve for the connection between coil body and base, which coil connection elements are fastened with horizontal fastening legs (33, 34, 35, 43, 44) in corresponding horizontal insert channels (13, 14, 15, 16, 17) of the coil flanges (11, 12). In addition, wind-on pieces (36, 46) which directly support the winding ends of the coil are formed onto the coil connection elements (3, 4). This results in a manufacture of the relay with few component parts which is simple and can be automated.

12 Claims, 3 Drawing Sheets

FIG 2
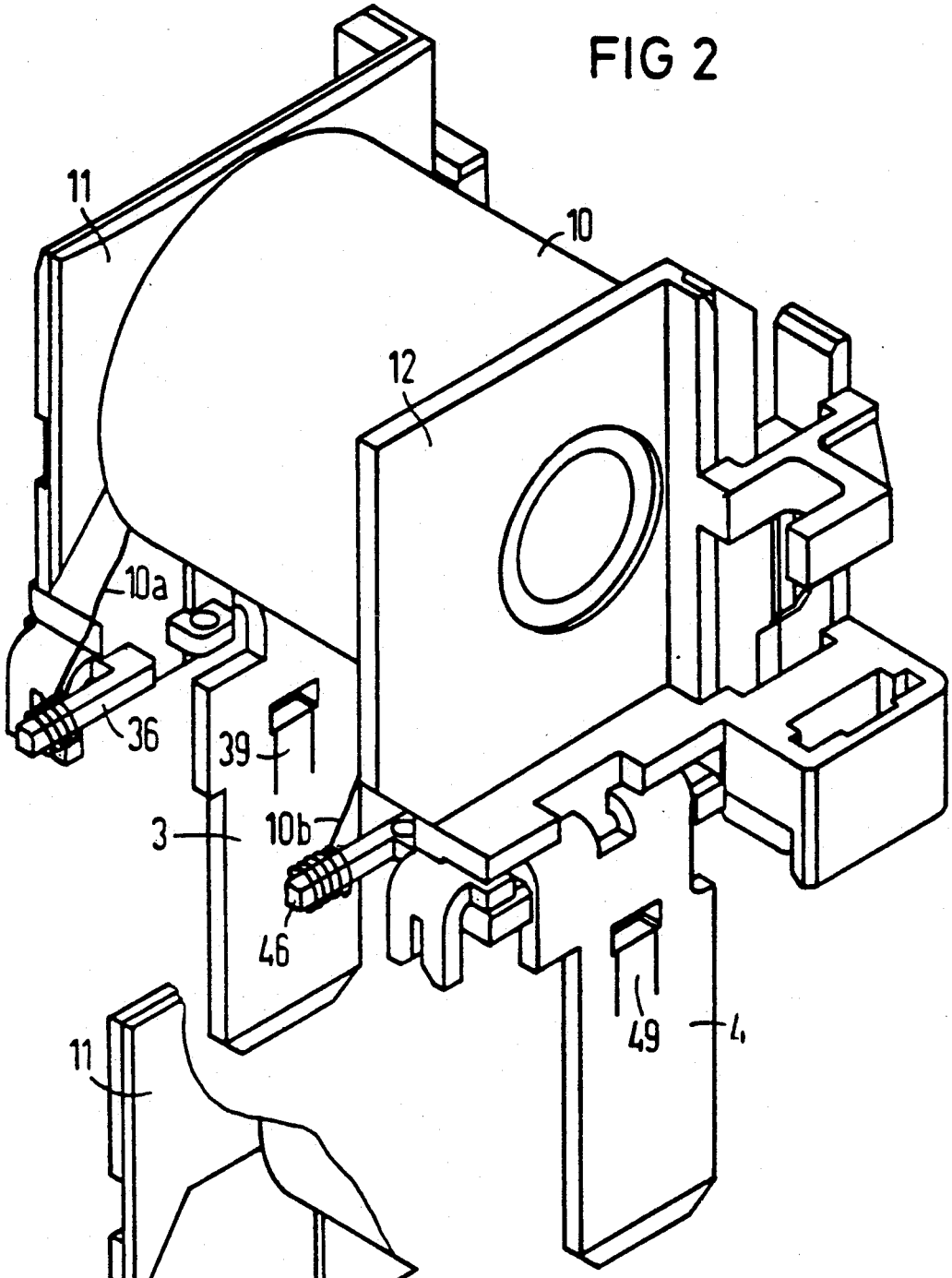
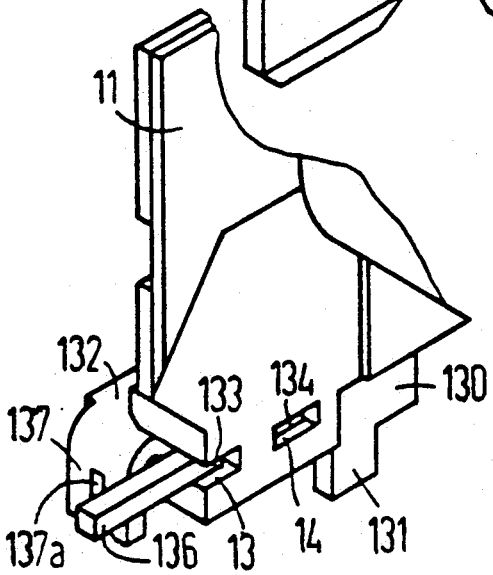
FIG 4

ELECTROMAGNETIC RELAY

The invention relates to an electromagnetic relay having the following features:

a) a coil body carries a winding applied between two coil flanges made of insulating material and also further magnetic circuit parts;

b) the coil body is fastened on a base made of insulating material, the coil axis being parallel to the basal plane of the base;

c) coil connection elements and contact connection elements are anchored in the base in insert slots perpendicular to the basal plane.

DESCRIPTION OF THE RELATED ART

Relays of this type are known in many forms, for example from European Published Application 0 281 950. In general, with such relays there is the problem that the coil and the base, including the function parts of the relay fastened on them, must be optimally joined to one another in as simple a manner as possible. Depending on the design, contact elements can thereby be fastened in the base or in the coil body by means of insertion, which also readily allows an automated assembly. The abovementioned publication already also states one possibility for forming an additional supporting arm onto a contact element for fastening the coil body on the base. Otherwise the connection of coil and base is essentially secured there by welded-on winding connections and finally by a housing cap.

With relays of this type there is a problem for the coil connections insofar as it is necessary to wind the coil itself in advance, during which the winding ends are usually fastened and soldered to winding support points. These winding support points in the form of pieces of wire or sheet-metal parts must therefore first be anchored in the coil body flanges, and in the case of the abovementioned relay they must be joined to the associated connection elements in the base by welding or soldering once the coil has been placed on the base. This thus entails an additional outlay with respect to component parts and assembly operations, as well as a plurality of connection points in series in the circuit.

Relays are admittedly also known in which winding support points anchored in the coil flanges are provided at the same time with formed-on connection elements which, if necessary, can also be inserted through cutouts in a base.

However, in this case there are also problems whenever, for reasons of space or for maintaining a particular connection grid, the wind-on pieces and/or the connection elements themselves project into the winding region, that is to say into the region through which the coil wire or a winding finger passes during winding of the coil. In such cases it is known to move wind-on pieces and/or connection elements into a position outside the winding region for the winding operation and only to bend them into their final position in the winding region after the winding (as shown in European Published Application 0 082 238). However, this requires costly bending devices. In particular, such a measure cannot be used for connection elements having a large cross-section, such as with flat connectors.

SUMMARY OF THE INVENTION

The object of the invention is to improve the connection of a coil body and a base in a relay of the type mentioned at the beginning, with as few component parts as possible permitting an automated assembly. The connection elements are thereby designed in such a way that it is also possible to wind on the winding ends simply and without additional wind-on elements, with there being as few connection points as possible in the electrical circuit of the coil. In addition, a method for manufacturing such a relay is disclosed.

This object is achieved according to the invention in a relay of the type mentioned at the beginning having the following additional features:

d) at least one of the coil flanges has at least one insert channel parallel to the coil axis for a fastening leg which is formed integrally onto a coil connection element; and e) a wind-on piece for in each case one winding end is integrally joined to the fastening leg in each case.

In the relay according to the invention, therefore, the coil connection elements have in each case hook-shaped fastening legs that are formed on parallel to the coil axis and hence to the basal plane, and which engage in corresponding insert channels on at least one coil flange, but expediently on both coil flanges. As a result of the anchoring of the coil connection elements in the base, the coil body is consequently positively held on the base. Since these fastening legs at the same time have formed-on wind-on pieces, which naturally project out of the respective insert channel, no additional winding support points are required for the winding on of the winding ends either; additional electrical connection points are thus also dispensed with in the coil circuit.

An expedient method for the manufacture of a relay according to the invention consists in that first of all the coil connection elements are inserted with their fastening leg in each case into a corresponding insert channel of a coil flange, in that the winding is then applied to the coil body and the winding ends are joined to one wind-on piece of a connection element in each case, and in that finally the coil is joined to the base, the coil connection elements being anchored in insert slots of the base.

In a preferred embodiment of the invention, the fastening legs are inserted into the flange in each case from the outside of a coil flange remote from the winding in the direction of the winding, the wind-on pieces lying in each case outside the insert channel. The fastening legs and the associated insert channels are thereby designed in each case in such a way that they can be fixed both in an intermediate position and in an end position, the respective wind-on piece being closer to the winding in the end position than when the intermediate position is assumed. It is thus possible for the fastening legs to be inserted into the insert channels of the respective coil flange before the application of the winding in each case only up to the intermediate position, and for them to be inserted further into the insert channels until they reach their end position after the winding, but before the assembly of the coil body on the base. This additionally produces a strain relief on the winding ends. Moreover, with such a design it is possible for the wind-on pieces and/or the connection elements themselves to project into the winding region in their end position, while they are still outside in the aforesaid intermediate position. Formed-on pieces, for example embossments, which ensure a sufficient degree of stability between connection element and coil body during winding can be provided for fixing the respective fastening leg in the intermediate position.

In an expedient embodiment, each coil connection element has in each case a fastening section parallel to the basal plane of the base with one or more horizontal fastening legs, from where a flat connector is bent perpendicularly downwards in each case. The flat connectors thereby serve not only to anchor the coil or the coil assembly in the base, but also for the direct plug-in connection of both winding ends in a receiving base. In this case, therefore, the contacting is effected from the respective wind-on piece up to the plug contacting via the integral coil connection element without there being any connection points in the form of a weld point or a solder point in between. If, however, a further component, such as a resistor or a diode, is to be connected in series with the coil winding, then it is expedient to design at least one of the coil connection elements with only one fastening section parallel to the basal plane of the base and with a securing pin bent perpendicularly thereto for anchoring in the base. In this case, therefore, this securing pin has no flat connector or connection pin, but rather serves only for the connection between coil body and base, while the electrical current path is conducted directly from the fastening section to a component connected thereto, and only then from there to a flat connector (or else solder connection) separately anchored in the base. In each of the two cases it is however expedient to provide on the coil connection element an integrally formed-on securing web for fastening and contacting an electrical or electronic component. In a preferred embodiment, said securing web has in each case one clamping slit for a solder-free clamp contacting.

BRIEF DESCRIPTION OF THE DRAWINGS

The invention is described in greater detail below using exemplary embodiments with reference to the drawing, in which FIG. 2 shows the coil body of FIG. 1 with a winding and with inserted coil connection elements, FIG. 4 shows a section from FIG. 2 with a modified embodiment of a connection element.

DETAILED DESCRIPTION OF THE PREFERRED EMBODIMENTS

Figure 1:
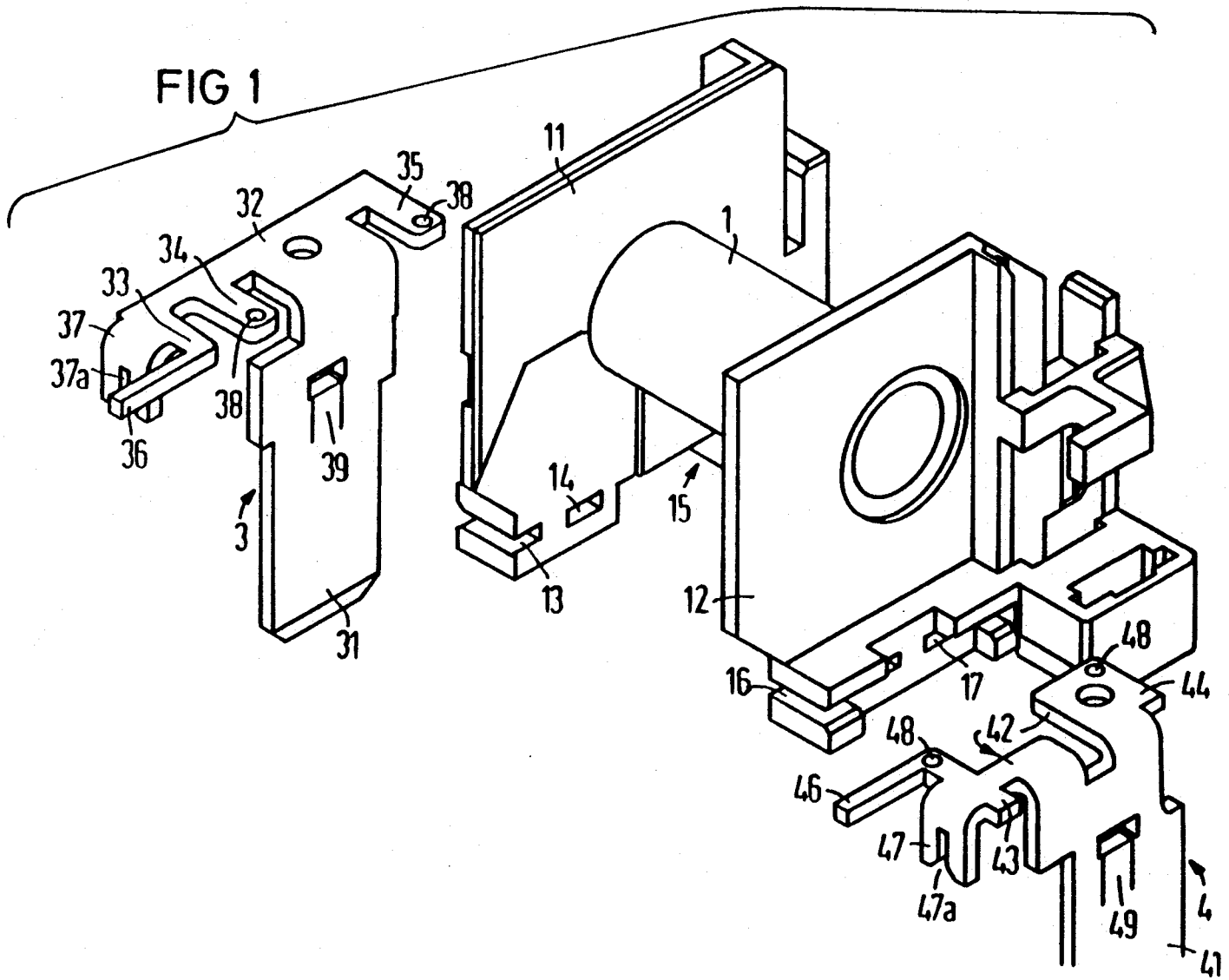
FIG. 1 shows a coil body for a relay according to the invention and two associated coil connection elements in an exploded illustration.
Figure 3:
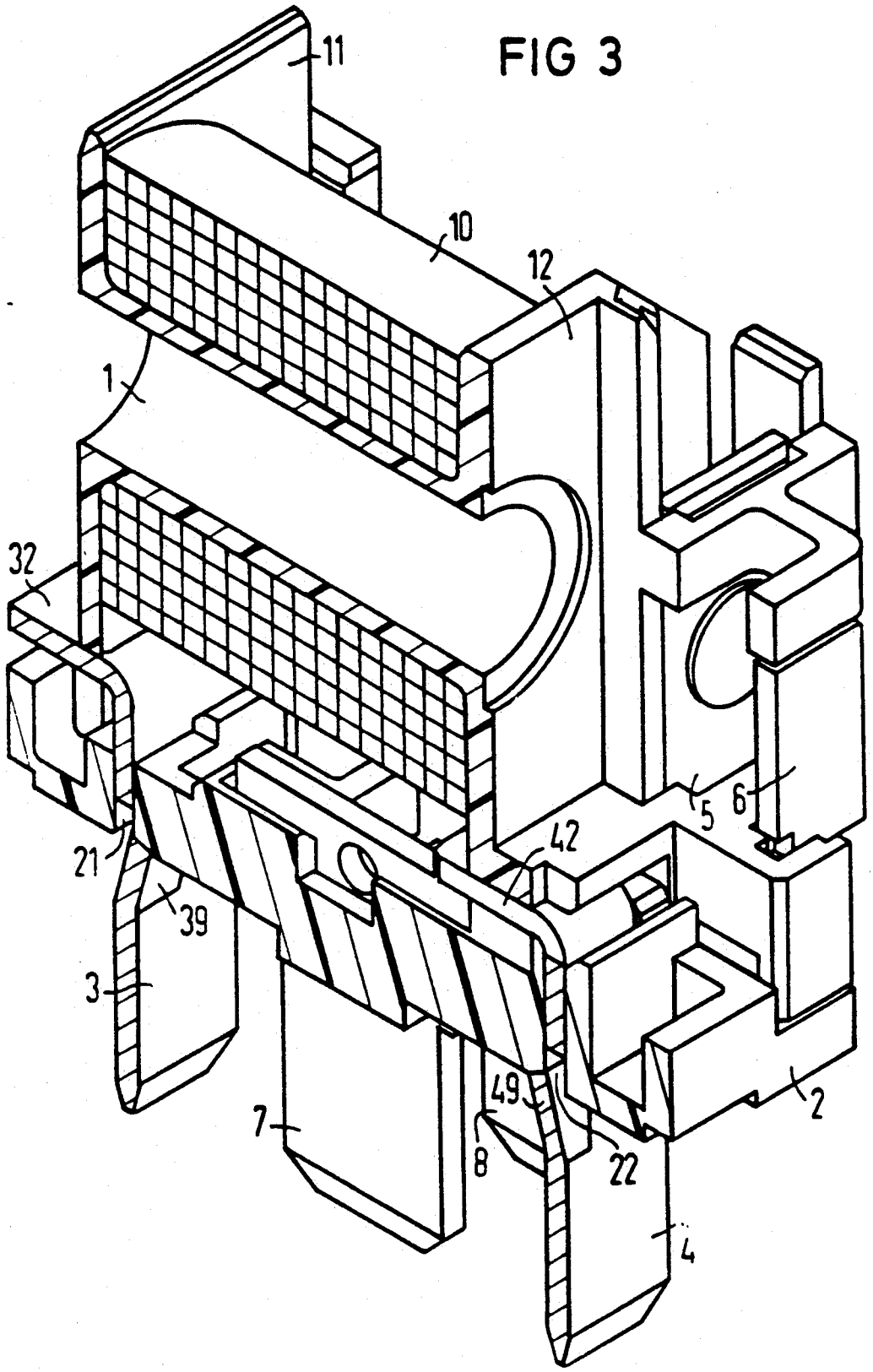
FIG. 3 shows the coil body of FIG. 2 assembled on a base in a sectional illustration.

A complete relay is shown in FIGS. 1 to 3, but rather only the parts essential for the invention, such as a coil body, a base and coil connection elements, are illustrated in detail. The omitted parts of the relay, such as a armature, a yoke and contact elements, insofar as they are not illustrated in FIG. 3, can be designed for instance like a relay in accordance with German Published Application 3 428 595 or European Published Application 0 281 950.

Illustrated in the figures is a coil body 1 made of insulating material, the hollow coil tube of which serves to accommodate a core (not illustrated). The coil body 1 has in each case a flange 11 and 12 respectively at the two ends. The ready-wound and assembled coil body is placed on a base 2 (FIG. 3), which is likewise made of insulating material. Prior to this, coil connection elements 3 and 4 which join the coil body to the base are inserted in each case into the coil flanges. In addition, contact elements 5 and 6 with their connection elements, and possibly also separate connection elements 7 and 8, are anchored in corresponding formed-on pieces and cut-outs of the coil body or of the base. Like the remaining design, the design of these parts is known so that it is not necessary to give further details here.

To accommodate the coil connection elements, each coil flange has insert channels which extend parallel to the coil axis or parallel to the basal plane of the relay. The coil flange 11 has an insert channel 13 open to the side as well as a closed insert channel 14 and also an insert channel 15 which is not visible. An insert channel 16 open to the side is provided beside a closed insert channel 17 in the coil flange 12. In the case of a normal installation position, the coil connection element 3 forms a perpendicular flat connector 31 and also a fastening part 32 bent at right angles at the top side. Cut out from said fastening part are three fastening legs 33, 34 and 35 which serve for horizontal insertion into the corresponding insert channels 13, 14 and 15 (not visible). Formed onto the fastening leg 33 at the side is a wind-on piece 36, which remains outside the insert channel 13 even when the fastening legs 33, 34, and 35 are inserted into the corresponding insert channels of the coil flange 11, and is thus suitable for winding on a winding end. In addition, a securing web 37 with a clamping slit **37*a* is formed on for fastening and contacting an additional component. Formed onto the fastening legs 34 and 35 are embossments 38** which serve for the temporary fixing of the respective fastening leg in the associated insert channel.

Analogously to the connection element 3, there are also a perpendicular flat connector 41 and a fastening part 42 bent at right angles thereto formed onto the coil connection element 4. Formed on this fastening part in turn are fastening legs 43 and 44, which can be inserted into corresponding insert channels 16 and 17 of the coil body flange 12. Formed on the fastening leg 43 at the side is a wind-on piece 46, which always projects laterally out of the open insert channel 16, even upon insertion into the coil body, in order to serve for winding on a winding end. Also formed on the fastening leg 43 is a securing web 47 with a clamping slit **47*a* for fastening and contacting an additional component. An embossment 48 in accordance with the embossment 38 is also formed in each case in the fastening legs 43 and 44**.

The assembly of the parts described will be explained in the text below. First of all the coil connection elements 3 and 4 are inserted into the coil body 1, the fastening legs 33, 34 and 35 being inserted into the insert channels 13, 14 and 15 up to an intermediate position at which the respective fastening legs and the flat connector 31 do not yet project over the interior wall of the coil flange 11 facing the winding region. In the same manner the coil connection element 4 is inserted with its fastening legs 43 and 44 into the coil flange 12 up to a corresponding intermediate position. The respective fastening legs are temporarily held in this intermediate position by the embossments 38 and 48 respectively. After this the winding 10 is applied, the winding ends **10*a* and 10*b* being wound on at the corresponding wind-on pieces 36 and 46 and being soldered or welded. The coil connection elements 3 and 4 are then pushed inwards toward the winding space up to their end position. The embossments 38 and 48 are thereby moved out of the region of the insert channels 13, 14, 15 and 16, 17 respectively so that the parts can again move freely. During subsequent insertion into the insert slots of the base they can thus adapt themselves to the given spacing dimension. As a result of the coil connection elements being pushed in up to their end position, the winding ends 10***a* and 10*b* of the coil wire are relieved of the tensile stress produced during winding. FIG. 2 shows this state.

Once the coil body has then been fitted with the further magnetic circuit parts that are not illustrated, it is placed on the base 2, the flat connectors 31 and 41 being inserted into the corresponding insert slots 21 and 22 of the base 2. After the plugging in, the connection elements 3 and 4 are fixed with the laterally bent out detent lugs 39 and 49 respectively (FIG. 3).

FIGS. 1 to 3 show an application example in which the winding ends are conducted out of the relay in each case directly via the two coil connection elements 3 and 4 and their flat connectors 31 and 41 respectively. In this case it is already possible to connect a component, such as a resistor or a diode, parallel to the coil between the two connection elements, which is carried out by means of the described securing webs 37 and 47 respectively. However, it is also conceivable to connect such a component accommodated in the relay in series with the coil winding. In this case, therefore, the component must be connected between the coil connection element and a plug connection, or else solder connection, which is electrically isolated therefrom. Such a possibility is shown in FIG. 4, which shows a section of the coil flange 11 from FIG. 2. In this arrangement, however, the coil connection element 3 is replaced by a modified connection element 130 which has however, as in the case described above, a fastening section 132 with fastening legs 133 and 134, and is fastened with these in the insert channels 13 and 14 of the coil flange 11. The corresponding winding end is fastened on the wind-on piece 136, and the securing web 137 with the clamping slit 137*a* serves for the clamp fastening of a connection wire for the aforesaid component.

In contrast to FIG. 2, the coil connection element 130 does not however have a flat connector, but rather only a securing pin which is formed on perpendicularly downwards, and which reaches with its length into the base and up to the underside thereof only so far that an anchoring in the base is possible, for example by means of notching. The current path thus leads from the winding end in question via the coil connection element 130 and the securing web 137 to the component (not shown), the end of the component remote from the securing web 137 being joined in a suitable manner to a separate (not shown) connection plug (or else a solder lug), which in turn is anchored in the base or in the coil body electrically isolated from the coil connection element 130. Naturally, a plurality of components may also be connected in series with or parallel to the winding ends in this manner, in which case an analogous modification of the second coil connection element 4 is also conceivable.

Although other modifications and changes may be suggested by those skilled in the art, it is the intention of the inventors to embody within the patent warranted hereon all changes and modifications as reasonably and properly come within the scope of their contribution to the art.

I claim:

1. An electromagnetic relay, comprising:

a coil body having two coil flanges of insulating material, said coil body defining a coil axis and having insert slots;

a winding on said coil body between said two coil flanges;

the coil body (1) is fastened on a base of insulating material and defining a basal plane, the coil axis being parallel to the basal plane of the base;

coil connection elements and contact connection elements anchored in the base in said insert slots perpendicular to the basal plane, said coil connection elements having fastening legs;

at least one of said two coil flanges defining at least one insert channel parallel to the coil axis for said fastening leg;

a wind-on piece for in each case one winding end of said winding being integrally joined to the fastening legs of each coil connection element in each case.

2. An electromagnetic relay according to claim 1, wherein said fastening legs are inserted into each of said two flanges from outside of a coil flange remote from the winding in the direction of the winding, the wind-on piece lying in each case outside the insert channel.

3. An electromagnetic relay according to claim 2, wherein said fastening legs are fixed in associated ones of said insert channels in an intermediate position and in an end position, the wind-on piece being closer to the winding in an end position in each case than when an intermediate position is assumed.

4. An electromagnetic relay according to claim 3, wherein in the intermediate position of the fastening leg the wind-on pieces are located outside a winding region, but project into the winding region when the end position is assumed:

5. An electromagnetic relay according to claim 4, wherein at least some of the fastening legs are provided with an embossment in a vicinity of their free end, which in the intermediate position of the coil connection element ensures in each case a preliminary fixing in an associated one of said insert channels.

6. An electromagnetic relay according to claim 1, wherein one of said coil connection elements is fastened in each of the two coil flanges, said coil connection elements being inserted in mutually opposite directions.

7. An electromagnetic relay according to claim 1, wherein each of said coil connection elements comprises a fastening section parallel to the basal plane of the base, from where at least one fastening leg extends horizontally, while a flat connector is bent perpendicularly downwards.

8. An electromagnetic relay according to claim 1, wherein at least one of the coil connection elements has a fastening section parallel to the basal plane of the base with one or more fastening legs, from where a securing pin is bent downwards perpendicular to the basal plane and is anchored in the base.

9. An electromagnetic relay according to claim 1, wherein on at least one of the coil connection elements is provided an integrally formed-on securing web for fastening and contacting an electrical or electronic component.

10. An electromagnetic relay according to claim 9, wherein said securing webs each have at least one clamping slit for a solder-free clamp contacting.

11. A method for manufacturing a relay, comprising the steps of:

inserting coil connection elements with their fastening legs into a corresponding insert channel of an associated coil flange, applying a winding to a coil body and connecting winding ends to one wind-on piece of a connection element in each case, and finally joining the coil body to a base, the coil connection elements being anchored in insert slots of the base.

12. A method according to claim 11, further comprising the steps of:

before said applying step, inserting the fastening legs into the insert channels of the respective coil flange up to an intermediate position, and further inserting said fastening legs into the insert channels until they reach their end position after the winding and before the joining of the coil body on the base.

* * * * *